US011606645B1

(12) United States Patent
Chan et al.

(10) Patent No.: US 11,606,645 B1
(45) Date of Patent: Mar. 14, 2023

(54) LOUDSPEAKER

(71) Applicant: Top Victory Investments Limited, Hong Kong (HK)

(72) Inventors: Ling Phin Darren Chan, Singapore (SG); Chin Beng Alvin Goh, Singapore (SG)

(73) Assignee: TOP VICTORY INVESTMENTS LIMITED, Hong Kong (HK)

( * ) Notice: Subject to any disclaimer, the term of this patent is extended or adjusted under 35 U.S.C. 154(b) by 6 days.

(21) Appl. No.: 17/456,536

(22) Filed: Nov. 24, 2021

(51) Int. Cl.
*H04R 9/06* (2006.01)
*H04R 7/18* (2006.01)
*H04R 1/28* (2006.01)

(52) U.S. Cl.
CPC ..... *H04R 9/063* (2013.01); *H04R 1/2834* (2013.01); *H04R 1/2842* (2013.01); *H04R 7/18* (2013.01); *H04R 9/06* (2013.01); *H04R 2307/207* (2013.01); *H04R 2499/11* (2013.01)

(58) Field of Classification Search
CPC .. H04R 1/2819; H04R 1/2834; H04R 1/2842; H04R 7/18; H04R 7/122; H04R 9/06; H04R 9/063; H04R 2307/207; H04R 2400/03; H04R 2499/11
See application file for complete search history.

(56) References Cited

U.S. PATENT DOCUMENTS

2007/0201712 A1* 8/2007 Saiki ..... H04R 1/2834 381/186
2010/0111343 A1* 5/2010 Hsu ..... H04R 1/2834 345/87
2017/0134848 A1* 5/2017 Shao ..... H04R 7/18

* cited by examiner

*Primary Examiner* — Huyen D Le
(74) *Attorney, Agent, or Firm* — Hamre, Schumann, Mueller & Larson, P.C.

(57) ABSTRACT

A loudspeaker includes a housing, a driver module and a vibrator module. The housing has a first wall section, and a second wall section that is spaced apart from the first wall section in a first direction. The driver module is mounted to the housing and includes at least one driver cone. The vibrator module includes a pair of first vibrators that are disposed on the first wall section and that are respectively located at two opposite sides of the driver module in a second direction perpendicular to the first direction and a pair of second vibrators that are disposed on the second wall section and that are respectively located at two opposite sides of the driver module in the second direction.

9 Claims, 4 Drawing Sheets

LOUDSPEAKER

FIELD

The disclosure relates to a loudspeaker, and more particularly to a loudspeaker with symmetric vibrators.

BACKGROUND

A conventional loudspeaker may include a casing, a speaker cone that is mounted to the casing, and a passive radiator that is mounted to the casing and that is driven by the speaker cone to oscillate in-phase with the speaker cone. As such, the sound waves generated/emitted from the passive radiator and the speaker cone add together to create an increase in sound-pressure-level of the lower-frequency sounds. However, in addition to the increase in sound-pressure-level, the passive radiator also generates unwanted vibrational forces in different directions that cause the casing to rattle or buzz badly. Complex and costly vibration dampening and/or isolation means may be needed for the conventional loudspeaker to reduce the vibration of the casing to an acceptable level.

Another conventional loudspeaker includes a casing, a speaker cone that is mounted to the casing, and two passive radiators that are respectively disposed at two opposite sides of the speaker cone. Through the abovementioned configuration, during operation of the conventional loudspeaker, when the speaker cone emits sound waves, each of the passive radiators is driven to generate a vibrational force. The vibrational forces generated by the passive radiators are equal in magnitude and direction, and respectively act on the opposite sides of the speaker cone. As such, the torques exerted by the vibrational forces with respect to a center of the speaker cone are balanced out, so that the casing of the conventional loudspeaker is prevented from vibrating about the speaker cone. However, the vibrational forces themselves generated by the passive radiators are not balanced cut, and will still drive the casing to rattle or buzz badly. Vibration dampening and/or isolation means may be still needed for the conventional loudspeaker to reduce the rattle or buzz caused by the passive radiators.

SUMMARY

Therefore, an object of the disclosure is to provide a loudspeaker that can alleviate at least one of the drawbacks of the prior art.

According to the disclosure, the loudspeaker includes a housing, a driver module and a vibrator module. The housing has a first wall section, and a second wall section that is spaced apart from the first wall section in a first direction. The driver module is mounted to the housing and includes at least one driver cone. The vibrator module includes a pair of first vibrators that are disposed on the first wall section and that are respectively located at two opposite sides of the driver module in a second direction perpendicular to the first direction and a pair of second vibrators that are disposed on the second wall section and that are respectively located at two opposite sides of the driver module in the second direction.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
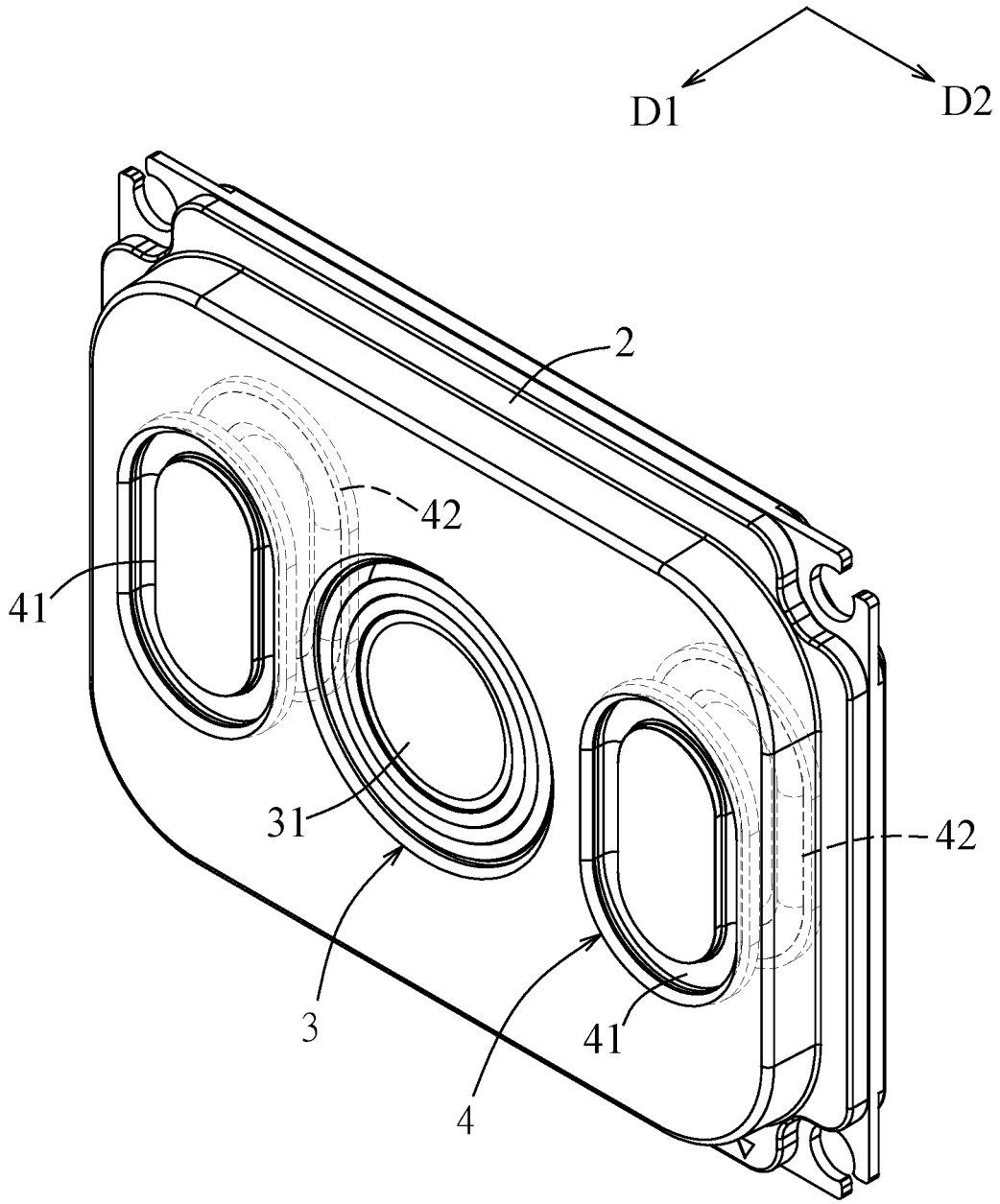
FIG. 1 is a perspective view illustrating an embodiment of a loudspeaker according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
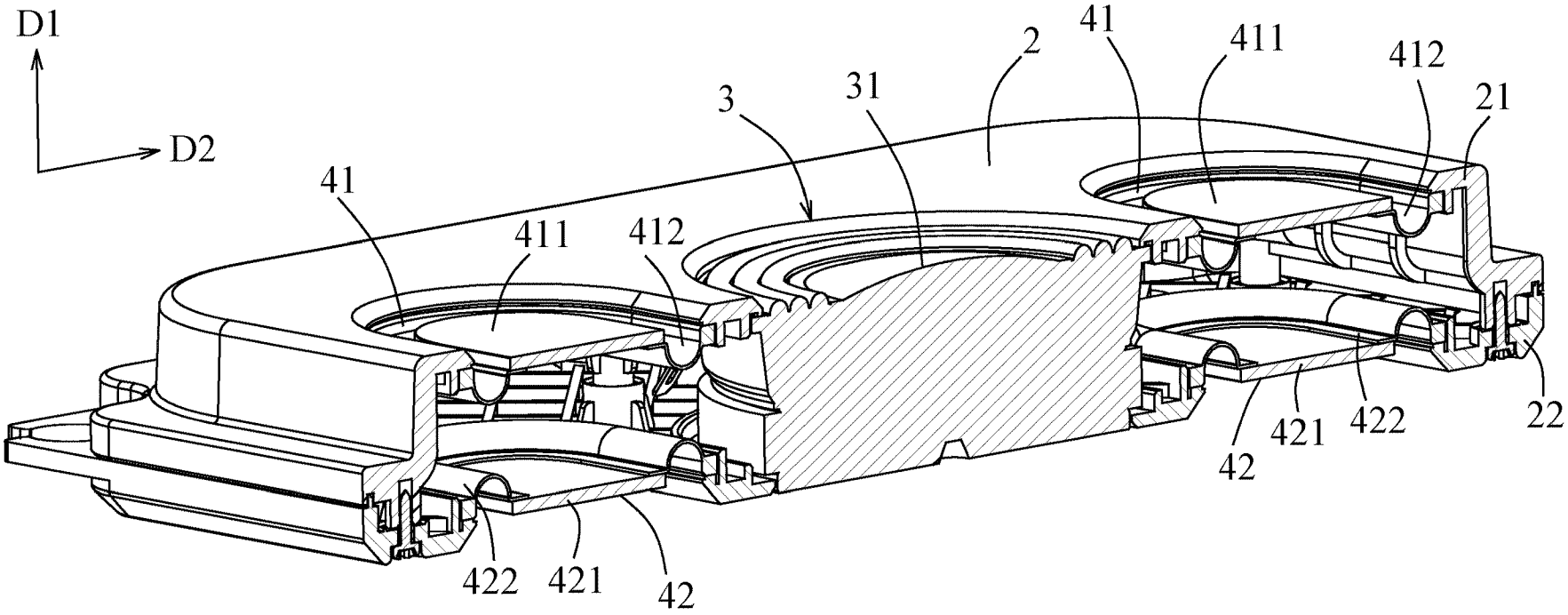
FIG. 2 is a cutaway perspective view illustrating the embodiment.

Referring to FIGS. 1 and 2, an embodiment of the loudspeaker according to the disclosure includes a casing or housing 2, a driver module 3 and a vibrator module 4.

The housing 2 has a first wall section 21, and a second wall section 22 that is spaced apart from the first wall section 21 in a first direction (D1) (e.g., a front-rear direction).

The driver module 3 is mounted to the housing 2, and includes at least one driver cone 31.

The vibrator module 4 includes a pair of first vibrators 41 and a pair of second vibrators 42. The first vibrators 41 and the second vibrators 42 may serve as passive radiators. The first vibrators 41 are disposed on the first wall section 21 and are respectively located at two opposite sides of the driver module 3 in a second direction (D2) perpendicular to the first direction (D1). The second vibrators 42 are disposed on the second wall section 22 and are respectively located at two opposite sides of the driver module 3 in the second direction (D2).

In one embodiment, the first vibrators 41 are structurally symmetric with respect to an imaginary plane that has a normal vector in the second direction (D2) and that passes through a center of the driver module 3. In one embodiment, the second vibrators 42 are structurally symmetric with respect to the imaginary plane that has the normal vector in the second direction (D2) and that passes through the center of the driver module 3.

In one embodiment, the first vibrators 41 are respectively aligned with the second vibrators 42 in the first direction (D1). Each of the first vibrators 41 and the respective one of the second vibrators 42 are structurally symmetric with respect to an imaginary plane that has a normal vector in the first direction (D1).

In one embodiment, each of the first vibrators 41 includes a first diaphragm 411, and a first rubber surround 412 that surrounds the first diaphragm. 411 and that is mounted to the first wall section 21 of the housing 2. Each of the second vibrators 42 includes a second diaphragm 421, and a second rubber surround 422 that surrounds the second diaphragm 421 and that is mounted to the second wall section 22 of the housing 2. The first vibrators 41 are structurally symmetric with respect to an imaginary plane that has a normal vector in the second direction (D2) and that passes through a center of the driver module 3. The second vibrators 42 are structurally symmetric with respect to the imaginary plane that has the normal vector in the second direction (D2) and that passes through the center of the driver module 3. The first vibrators 41 are respectively aligned with the second vibrators 42 in the first direction (D1), and each of the first vibrators 41 and the respective one of the second vibrators 42 are structurally symmetric with respect to an imaginary plane that has a normal vector in the first direction (D1).

For each of the first and second vibrators 41, 42, the mass of the diaphragm 411, 421 and the elasticity of the rubber surround 412, 422 are tuned such that when this mass-spring combination (i.e., an assembly of the diaphragm 411, 421 and the rubber surround 412, 422) oscillates near its resonant frequency, the first/second vibrator 41, 42 oscillates in-phase with the driver cone 31 of the driver module 3. As such, the sound waves generated/emitted from the first and second vibrators 41, 42 and the driver cone 31 add together to create an increase in sound-pressure-level.

By virtue of the abovementioned configuration, during operation of the loudspeaker according to the disclosure, when the driver cone 31 of the driver module 3 emits sound waves, each of the first vibrators 41 generates a first vibrational force in the first direction (D1), and each of the second vibrators 42 generates a second vibrational force in a direction opposite to that of the first vibrational forces. The first vibrational forces generated by the first vibrators 41 are equal in magnitude, and respectively act on the opposite sides of the driver module 3. The second vibrational forces generated by the second vibrators 42 are equal in magnitude, and respectively act on the opposite sides of the driver module 3. The first vibrational forces generated by the first vibrators 41 and the second vibrational forces generated by the second vibrators 42 are equal in magnitude. By such, the torques exerted by the first vibrational forces with respect to the driver module 3 are balanced out, the torques exerted by the second vibrational forces with respect to the driver module 3 are balanced out, and the first vibrational forces and the second vibrational forces themselves are balanced out. As a result, the casing of the loudspeaker is prevented from vibrating about the speaker cone, and is prevented from vibrating in the first direction (D1).

Figure 3:
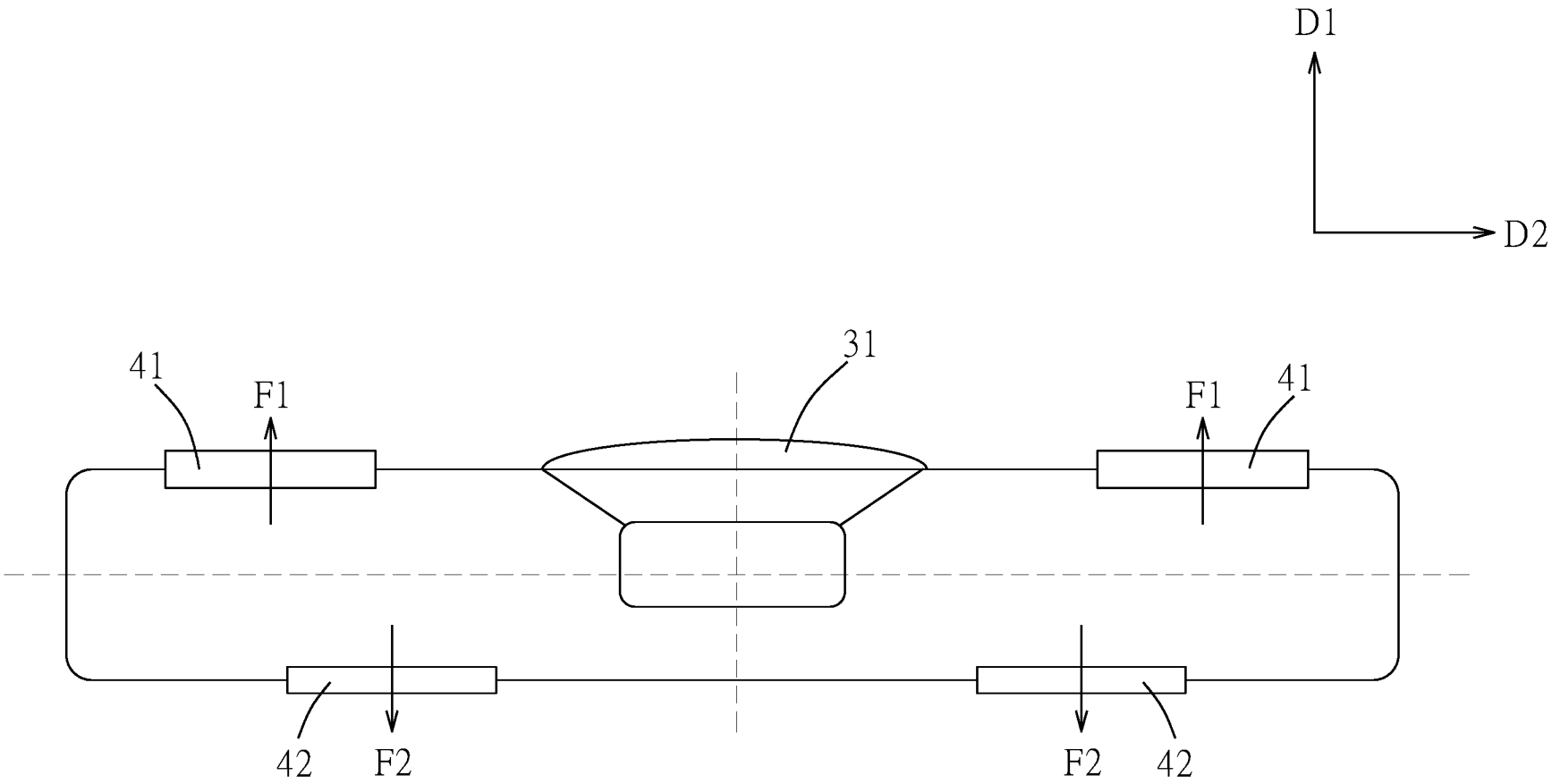
FIG. 3 is a schematic sectional view illustrating another example of the loudspeaker.

Referring to FIG. 3, in another example according to the disclosure, the first vibrators 41 are configured not to be aligned with the second vibrators 42 in the first direction (D1). In operation, when the driver cone 31 emits sound waves, each of the first vibrators 41 generates a first vibrational force (F1) in the first direction (D1), and each of the second vibrators 42 generates a second vibrational force (F2) in a direction opposite to that of the first vibrational forces (F1). The first vibrational forces (F1) generated by the first vibrators 41 and the second vibrational forces (F2) generated by the second vibrators 42 are equal in magnitude. By such, the torques exerted by the first vibrational forces (F1) with respect to the driver module 3 are balanced out, the torques exerted by the second vibrational forces (F2) with respect to the driver module 3 are balanced out, and the first vibrational forces (F1) and the second vibrational forces (F2) themselves are balanced out. As a result, the casing of the loudspeaker is prevented from vibrating about the speaker cone, and is prevented from vibrating in the first direction (D1).

Figure 4:
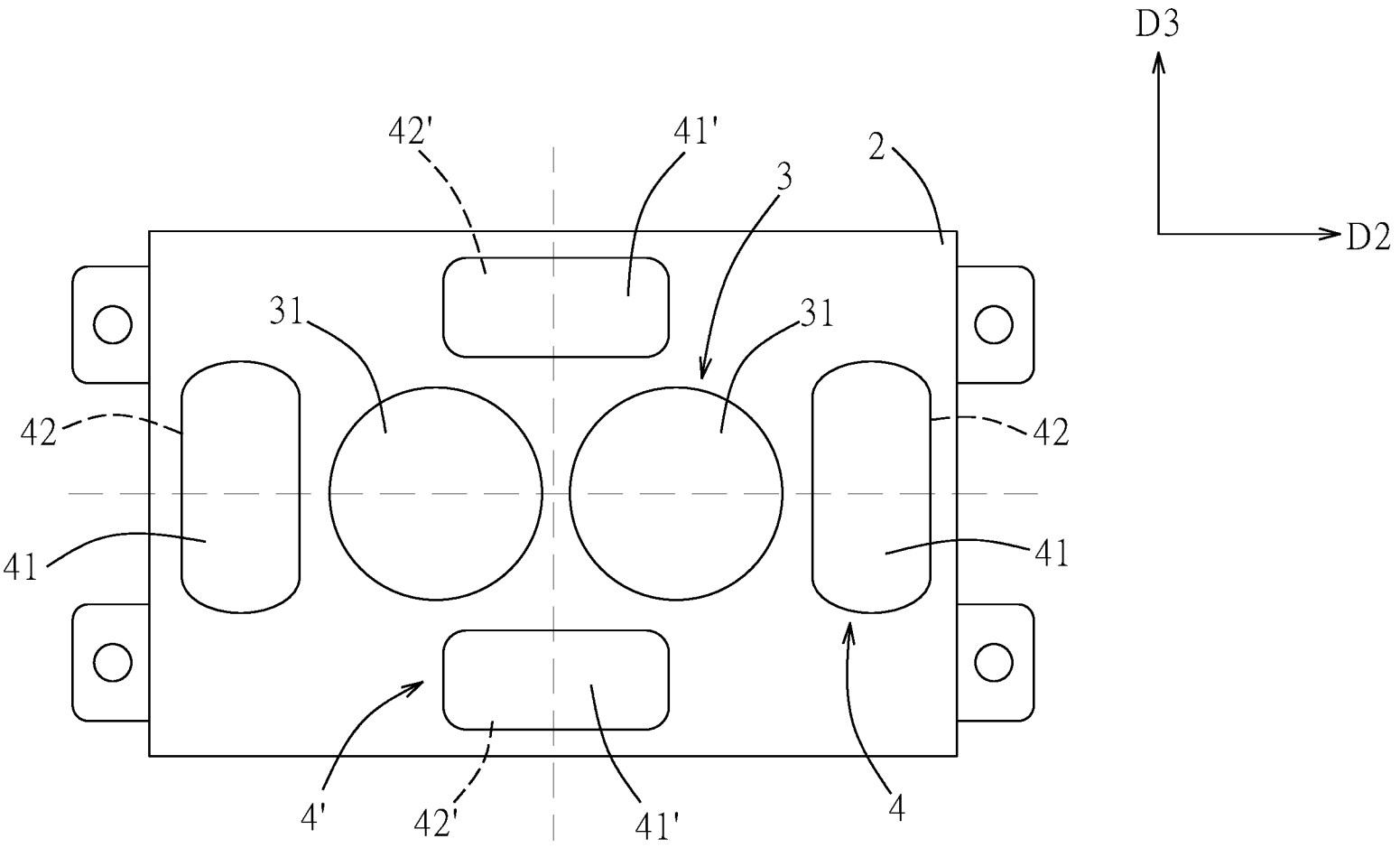
FIG. 4 is a schematic plan view illustrating still another example of the loudspeaker.

Referring to FIG. 4, in still another example according to the disclosure, the driver module 3 includes two driver cones 31 that are mounted to the housing 2, and the loudspeaker further includes an additional vibrator module 4'. The additional vibrator module 4' includes a pair of first vibrators 41' that are disposed on the first wall section (21, with reference to FIG. 2) and that are respectively located at two opposite sides of the driver module 3 in a third direction (D3) perpendicular to the first direction (D1), and a pair of second vibrators 42' that are disposed on the second wall section (22, with reference to FIG. 2) and that are respectively located at two opposite sides of the driver module (3) in the third direction (D3). Similar to the abovementioned embodiments and examples, when the driver cones 31 emits sound waves, the torques exerted by the vibrational forces generated by the first and second vibrators 41, 42 of the vibrator module 4 and the first and second vibrators 41', 42' of the additional vibrator module 4' with respect to the driver module 3 are balanced out, and the vibrational forces themselves are balanced out. As a result, the casing of the loudspeaker is prevented from vibrating about the speaker cone, and is prevented from vibrating in the first direction (D1). It should be noted that the third direction (D3) may be the same as the second direction (D2) or may be different from the second direction (D2)

In still another examples, the driver module 3 may include more than two driver cones 31, and the loudspeaker may include more than one additional vibrator module 4'.

In summary, when the loudspeaker according to the disclosure is in operation, the housing 2 is prevented from vibrating about the driver module 3 and from, vibrating in the first direction (D1). As such, vibration of the loudspeaker is reduced to an acceptable level by virtue of the first and second vibrators 41, 42, and complex and costly vibration dampening and/or isolation means may not be needed In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from, one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A loudspeaker comprising:

a housing having a first wall section, and a second wall section that is spaced apart from said first wall section in a first direction;

a driver module mounted to said housing and including at least one driver cone; and a vibrator module including a pair of first vibrators that are disposed on said first wall section and that are respectively located at two opposite sides of said driver module in a second direction perpendicular to the first direction; and a pair of second vibrators that are disposed on said second wall section and that are respectively located at two opposite sides of said driver module in the second direction.

2. The loudspeaker as claimed in claim 1, wherein said first vibrators are respectively aligned with said second vibrators in the first direction.

3. The loudspeaker as claimed in claim 1, wherein said first vibrators are configured not to be aligned with said second vibrators in the first direction.

4. The loudspeaker as claimed in claim 1 wherein each of said first vibrators includes a first diaphragm, and a first rubber surround that surrounds said first diaphragm and that is mounted to said first wall section of said housing.

5. The loudspeaker as claimed in claim 1, wherein each of said second vibrators includes a second diaphragm, and a second rubber surround that surrounds said second diaphragm and that is mounted to said second wall section of said housing.

6. The loudspeaker as claimed in claim 1, wherein:

each of said first vibrators includes a first diaphragm, and a first rubber surround that surrounds said first diaphragm and that is mounted to said first wall section of said housing;

each of said second vibrators includes a second diaphragm, and a second rubber surround that surrounds said second diaphragm and that is mounted to said second wall section of said housing;

said first vibrators are respectively aligned with said second vibrators in the first direction; and each of said first vibrators and the respective one of said second vibrators are structurally symmetric with respect to an imaginary plane that has a normal vector in the first direction.

7. The loudspeaker as claimed in claim 1, further comprising at least one additional vibrator module that including a pair of first vibrators that are disposed on said first wall section and that are respectively located at two opposite sides of said driver module in a third direction perpendicular to the first direction, and a pair of second vibrators that are disposed on said second wall section and that are respectively located at two opposite sides of said driver module in the third direction.

8. The loudspeaker as claimed in claim 7, wherein the third direction and the second direction are the same.

9. The loudspeaker as claimed in claim 7, wherein the third direction and the second direction are different from each other.

* * * * *